United States Patent [19]

Gilbert et al.

[11] 4,112,846

[45] Sep. 12, 1978

[54] ARMOR-PIERCING INCENDIARY PROJECTILE

[75] Inventors: Henry L. Gilbert, Compton; Cayrl W. Van Ordstrand, Redondo Beach, both of Calif.

[73] Assignee: Martin Marietta Aluminum Inc., Torrance, Calif.

[21] Appl. No.: 602,852

[22] Filed: Dec. 19, 1966

Related U.S. Application Data

[63] Continuation-in-part of Ser. No. 477,077, Jun. 11, 1966, abandoned, which is a continuation-in-part of Ser. No. 360,554, Apr. 16, 1954, abandoned.

[51] Int. Cl.[2] ..... F42B 11/14

[52] U.S. Cl. ..... 102/52

[58] Field of Search ..... 75/177, 10 FR; 102/52 X, 66 X, 90 X

[56] References Cited

U.S. PATENT DOCUMENTS

| | | | |
|---|---|---|---|
| 841,753 | 1/1907 | Wheeler et al. | 102/52 |
| 1,562,540 | 11/1925 | Cooper | 75/177 |
| 2,490,570 | 12/1949 | Anicetti | 75/177 |
| 2,490,571 | 12/1949 | Anicetti | 75/177 |
| 2,775,514 | 12/1956 | Wainer | 75/177 |
| 2,975,710 | 3/1961 | Read | 102/90 X |
| 3,028,808 | 4/1962 | Porter et al. | 102/52 |
| 3,096,715 | 7/1963 | Dufour | 102/52 |
| 3,302,570 | 2/1967 | Marquardt | 102/52 |

FOREIGN PATENT DOCUMENTS

| | | | |
|---|---|---|---|
| 671,171 | 4/1952 | United Kingdom | 75/10 |

*Primary Examiner*—Harold Tudor
*Attorney, Agent, or Firm*—Millen & White

[57] ABSTRACT

There is provided an improved armor-piercing incendiary projectile having within the nosepiece thereof an incendiary comprising a matrix of a first metal selected from the group consisting of zirconium, titanium, thorium, hafnium, uranium, and mixtures thereof; and an intermetallic compound formed between the matrix and a second metal selected from the group consisting of tin, lead, and mixtures thereof. Upon impact with armor, the incendiary burns at temperatures heretofore unattainable, as well as providing cushioning and lubrication for the penetrator.

14 Claims, 3 Drawing Figures

INVENTORS.
HENRY L. GILBERT
& CAYRL W. VAN ORDSTRAND
BY [illegible]
& [illegible]
AGENT

ARMOR-PIERCING INCENDIARY PROJECTILE

This is a continuation-in-part of copending U.S. pat. application, Ser. No. 477,077, filed June 11, 1966, now abandoned, which is a continuation-in-part of abandoned U.S. pat. application, Ser. No. 360,554, filed Apr. 16, 1954, now abandoned.

In the conventional armor-piercing incendiary projectiles, an admixture of particulate incendiary material, such as, magnesium/aluminum alloy, barium nitrate, ammonium perchlorate, etc. is carried in the hollow nosepiece thereof (See U.S. Pat. No. 3,028,808). Such incendiary materials are extremely hazardous to handle and great care must therefore be exercised in normal loading operations. The incendiary is usually compacted and partitioned from the penetrator by a retaining disc or ballistic cap. Because the pointed nose of the steel penetrator tends upon impact to shear or rupture, and thus retard penetration, the ballistic cap is conventionally constructed from a material which also cushions the initial impact and prevents deformation of the penetrator nose. Materials from which the cap can be fabricated to provide satisfactory cushioning are, for example, aluminum, lead, and the alloys thereof.

The ballistic cap fabricated from these materials also acts as a lubricant between the steel penetrator and the armor plate, such lubrication being necessary if relatively thick armor is to be penetrated. The incendiary compositions utilized heretofore do not, however, provide lubrication between the penetrator and armor, and the use of such lubricating caps is necessary.

Further, high speed photographs taken on the firing range reveal that upon striking an armored target, the thin-walled nosepiece of the conventional projectile ruptures releasing a major portion of the incendiary on the entry side of the armor. Under normal conditions, the released incendiary ignites and is completely consumed before traversing the armor. In a series of firing tests, where armor plate is completely breached, the penetrator passes therethrough carrying little or no unreacted incendiary into the true target zone. Consequently, when these projectiles strike targets, such as, aircraft, or petroleum storage facilities, the incendiary effect within the target zone is minimal because ignition, and almost complete consumption of incendiary, occurs at the instant of impact on the entry side instead of during and after penetration of the armor.

It is, therefore, a principal object of the invention to provide an improved armor-piercing projectile having a delayed action incendiary charge which ignites during penetration and continues to burn after breaching the armor;

Another object is to provide in an armor-piercing projectile an improved incendiary charge which can be handled without fear of ignition and is capable of generating within the target zone temperatures heretofore unattainable;

Yet another object is to provide an improved armor-piercing incendiary projectile for use against petroleum storage vessels which will cause internal ignition of petroleum products stored therein;

Still another object is to provide for an armor-piercing projectile an incendiary charge which also serves as a cushion and lubricant for the penetrator.

Other objects and advantages of the invention will become apparent upon reference to the following description, drawings, and claims appended hereto.

To attain these objects, there is provided within the nosepiece of an otherwise conventional armor-piercing projectile a solid incendiary comprising a matrix of a first metal selected from the group consisting of zirconium, titanium, thorium, hafnium, uranium, and mixtures thereof; and an intermetallic compound formed between the matrix and a second metal selected from the group consisting of tin, lead, and mixtures thereof.

By utilizing this incendiary in the projectile, preferably adjacent the solid penetrator, it was surprisingly discovered that the matrix not only ignites during and after penetration of the armor, but also provides the desired cushioning and lubrication for the penetrator.

The aluminum ballistic cap employed in conventional armor-piercing incendiary projectiles is believed to deform plastically and flow upon impact, thereby cushioning the nose of the penetrator and providing lubrication therefor. It was therefore believed necessary to fabricate the cap from a metal having a hardness and ductility similar to aluminum. As compared with aluminum, the zirconium-tin composition is, however, about three times harder (measured by Brinell Hardness No.). Unlike the aluminum cap, the matrix of the present invention is frangible and tends to rupture into a multiplicity of particles upon impact at high velocity. It was therefore unexpected to find that a hard and frangible zirconium-tin matrix provides the desired cushioning for the penetrator and also acts as a lubricant therefor.

Without being bound by an explanation of the properties or characteristics of the zirconium-tin composition, which accounts for its unexpected lubricating qualities under the conditions of use, it is believed, for example, that the steel armor in contact with burning matrix is instantaneously liquified, resulting in the formation of a low melting eutectic alloy of zirconium-steel. The solid penetrator and unreacted matrix are then believed to be wet by this liquid alloy, friction between the projectile and armor through which it is passing thus being reduced to a minimum.

In the incendiary compositions suitable for use herein, the first matrix metal comprises, based upon the total weight of incendiary, of from about 70 to 98.5, preferably 80 to 95, more preferably 85 to 90% by weight; and the second metal which forms the intermetallic compound in the matrix comprises from about 1.5 to 30, preferably 5 to 20, more preferably 10 to 15% by weight of the incendiary.

According to the present invention, the incendiary composition can be produced, for example, by compacting into a bar a mixture comprising about 85% by weight sponge zirconium and about 15% by weight of 80 mesh tin powder. Two or more such bars are then positioned end-to-end and arc-welded together under an inert atmosphere to form a single electrode. The resultant electrode is then melted by conventional arc methods under vacuum to form an ingot, which is again utilized as an electrode and remelted by an electric arc under vacuum to form an ingot. The resultant ingot can then optionally be encased in an iron jacket, heated to about 1,720° F., and extruded while in the jacket into the desired cross-sectional area. If desired, any other method can be used to form the solid incendiary into an advantageous shape. The extruded incendiary can then be further shaped into the desired configuration by conventional methods.

In this so-called double melt process, the first metal, such as, zirconium, forms a matrix having dispersed therein an intermetallic compound, such as, zirconium-tin. This intermetallic compound is believed to be present in the matrix in the form of crystals or particles, the size of which can be governed by the rate at which the remelted ingot is cooled. For example, by holding the incendiary composition during its synthesis at or above the melting temperature over a prolonged period, the crystals and/or particles of intermetallic compound tend to coalesce and grow. The preferred composition, however, desirably contains relatively small particles of the intermetallic compound more or less uniformly and ubiquitously distributed within the matrix.

The incendiary composition produced in the foregoing manner can be shaped without danger of ignition by conventional methods, such as, abrading, sawing, filing, machining, and cutting, etc. Although the exact mechanism required in triggering ignition is unknown, experience has demonstrated that the composition can be handled and loaded with safety, ignition occurring only when it is impacted at extremely high velocities. In tests, for example, with a 120 grain incendiary composition produced according to the present invention, impact velocities of approximately 1,700 to 2,000 feet per second are required for ignition. However, in the fabrication and shaping of this same composition, there is surprisingly no danger whatever of auto-ignition, even when the composition is machined or accidentally dropped onto a hard surface.

Within limits, the incendiary composition can be varied to suit the condition of use. For example, armor-piercing incendiary projectiles for use against tank armor are advantageously heavier and it may be desirable to utilize in forming the matrix a metal having a greater density, such as, hafnium or uranium. Where the projectile is to be fired from an aircraft and weight considerations are of prime importance, it is desirable to employ a lower density matrix material, such as, titanium.

Upon application of an impact force sufficient to shatter the above-described solid incendiary, ignition occurs at or on the freshly exposed surfaces. The combusting surfaces then appear to peel off explosively, creating additional combusting particles. As a result, any and all underlying pyrophoric intermetallic compound is exposed and ignited in a somewhat cascading fashion, i.e., the violence of burning is explosive causing fragments of matrix and/or pyrophoric intermetallic compound to spray outwardly. Because the incendiary generates extremely high flame temperatures, on the order of about 4,000° F. to 9,000° F., the burning incendiary itself can also melt holes in thin armor plate, such as, the skin of aircraft.

The invention is illustrated further in the accompanying drawings, in which.

Figure 1:
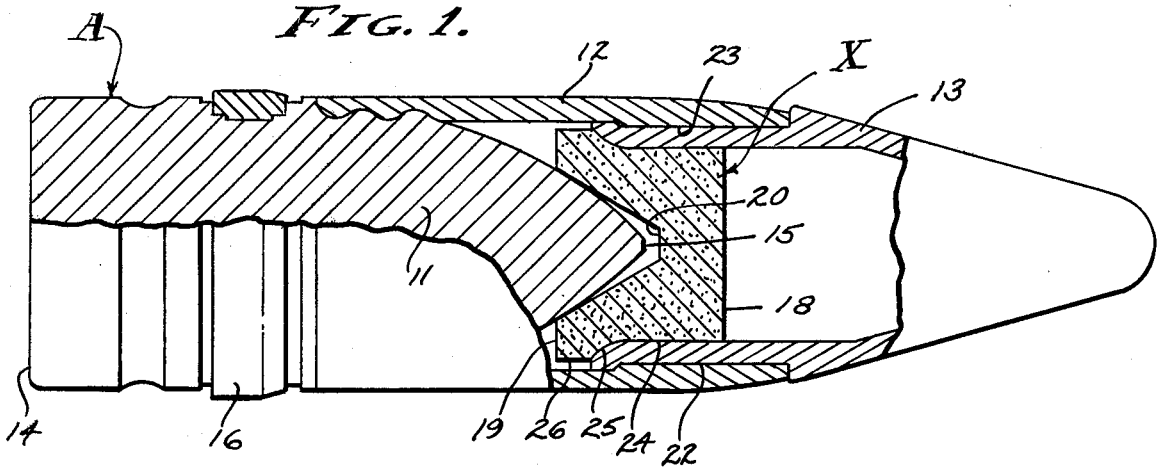
FIG. 1 is a fragmentary sectional view taken along the longitudinal axis of an armor-piercing incendiary projectile according to the present invention, particularly illustrating a preferred form of the incendiary cooperatively assembled therein.

Referring now to the drawings, an armor-piercing incendiary projectile shown generally at A comprises a steel penetrator 11 having a base or butt end 14 normal to the longitudinal axis, and a conical or ogival-shaped nose which terminates at point 15 (FIG. 1). A rotating band 16 girdles penetrator 11 at about the midpoint thereof and cooperates during firing with rifling in the weapon's barrel to produce spin. About the penetrator nose, and in juxtaposition therewith, is a cylindrical incendiary element X having a flat front face 18 and a rear face 19 having a recess or cavity 20 therein. A major portion of the internal surface of recess 20 is preferably in contact with the penetrator, although for ease of manufacturing, the base of recess 20 in the assembled projectile is spaced from the point 15 of the penetrator.

The incendiary X shown in FIG. 1 is illustrative only, and any other desired shape of incendiary charge can be used. For example, when it is desired to maintain incendiary in contact with the entire surface of the penetrator nose, a recess 20 in the incendiary is formed with its walls corresponding in contour to those of the penetrator nose. Further, the front end 18 of incendiary element X can, if desired, be conical shaped to facilitate penetration thereof through armor. Where a relatively long delay in ignition of incendiary is desired, a conventional lubricating cap of aluminum can advantageously be used over the front end of the incendiary.

Figure 3:
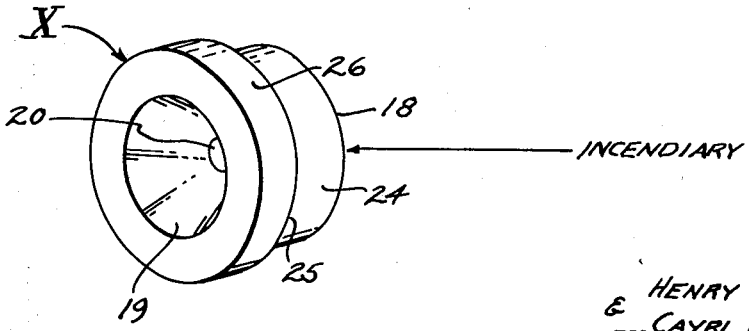
FIG. 3 is an enlarged detailed perspective view of a preferred form of the incendiary element for use herein.

Forward of the penetrator is a hollow thin-walled nosepiece 13 which can optionally be coupled to penetrator 11 via a tubular adapter 12. Although any conventional nosepiece which locks directly onto the penetrator can be used, it is preferred to employ an adapter which can be mounted onto the penetrator nose and wastened thereon by means of serrations. To assist in interlocking all elements, the cylindrical walls 24 of the incendiary flare outwardly forming an arcuate surface 25 and a radially projected flange 26 (FIGS. 1 and 3). The tubular rear portion 23 of the nosepiece has an outside diameter equal to the inside diameter of the inwardly projecting portion 22 of the adapter.

In assembling the projectile, incendiary element X is inserted into the adapter after it is affixed to the penetrator. When the incendiary is properly situated on the penetrator nose, the end 23 of the nosepiece is pressed rearwardly to wedge the same between incendiary surface 24 and the inwardly projecting adapter surface 22. Upon further rearward axial movement, against the outwardly flared surface 25, the end of the nosepiece is bent or deflected outwardly and locked against the inside surface of the adapter.

The adapter sleeve 12 and nosepiece 13 can, if desired, be replaced by a one-piece adapter-nosepiece combination. Also, the foregoing prefered means used to encapsule and lock the incendiary into the projectile can advantageously be replaced by any other of the conventional nosepieces.

Figure 2:
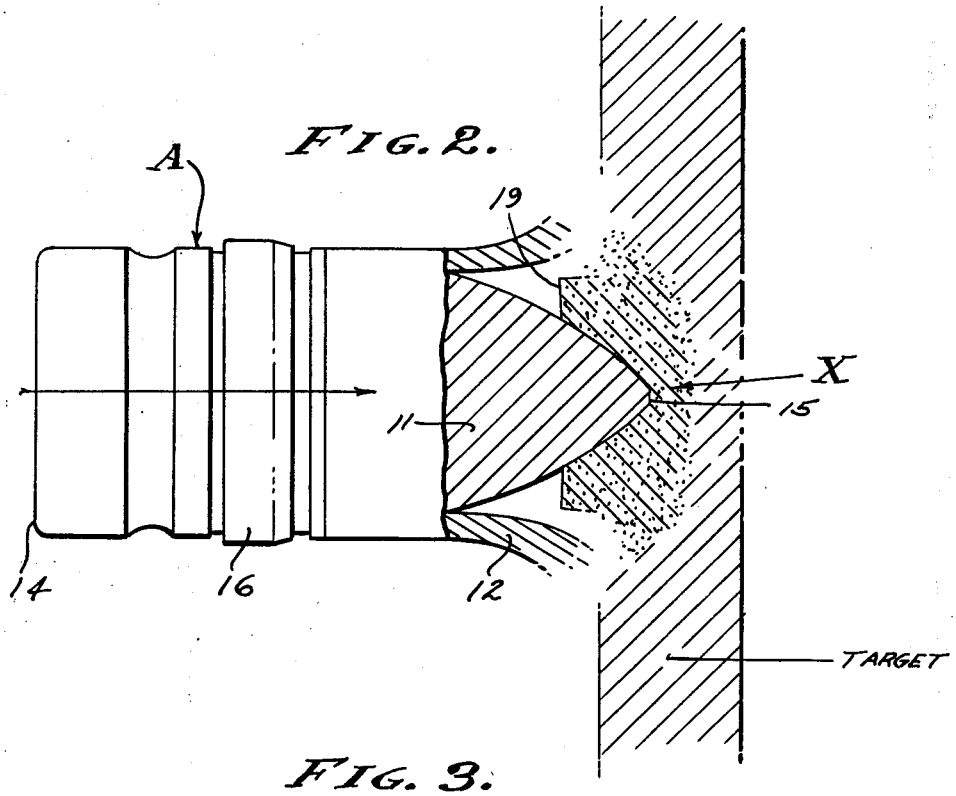
FIG. 2 shows the destructive effect on the projectile nosepiece of FIG. 1 as it strikes armor.

Upon impact with armor, the nosepiece of the above-described projectile tends to break up as in FIG. 2, leaving the burning incendiary directly in contact with target plate. At the same time, the penetrator 11 pushes the incendiary forward against armor, crushing and simultaneously igniting during travel. Because the nosepiece is believed to be destroyed before incendiary is ignited, it is desirable in some applications to omit the nosepiece entirely and use instead an incendiary element having a ballistic conical nose.

EXAMPLE I

A series of tests are made on the firing range with 20mm armor-piercing incendiary projectiles containing the above-described zirconium-tin incendiary composition in the nosepiece thereof. One hundred rounds each are fired at ¼ inch thick aluminum target plates stationed a distance of 300 and 1,000 meters, respectively, from the firing site. In all cases, the projectiles pass through the plates, the incendiary is ignited during penetration, and combustion continues thereafter. Photographs of these tests reveal that continuous ignition of incendiary occurs during and after penetration, as well as after the projectile passes from about 1 to 50 feet beyond the target.

In a series of comparative firings with 200 rounds of conventional 20mm armor-piercing incendiary projectiles, continued ignition of incendiary after passage of the projectile through the aluminum target plate occurs only randomly in less than thirty percent of the firings.

These tests thus demonstrate that the projectiles of the present invention not only penetrate an armored target with the same effectiveness as conventional armor-piercing projectiles, but surprisingly continue to burn with cascading thermal fragmentation after penetration to achieve maximum incendiary effect in the primary target zone.

EXAMPLE II

In this example, a series of tests are made on the firing range at two open-topped storage vessels fabricated from ¼ inch thick steel plate, each containing one hundred gallons of gasoline. These vessels are stationed at 300 and 1,000 meters, respectively, from the firing site and one hundred rounds of 20mm armor-piercing incendiary projectiles containing the zirconium-tin incendiary are fired at each vessel.

A series of firing tests are then conducted under similar conditions using two hundred rounds of conventional 20mm armor-piercing incendiary projectiles. A photographic comparison of these firings shows that the projectiles of the present invention provide over a 200 percent improvement in the internal ignition of gasoline in the vessels as evidenced by the eruption of flames from the upper surface thereof.

These foregoing tests demonstrate that the incendiary projectiles of the present invention penetrate the wall of normal petroleum storage vessels and quite unexpectedly generate sufficient heat after penetration to raise the temperature of immediately surrounding petroleum products above their flash point, causing them to erupt into flames.

EXAMPLE III

Three series of firing tests are made on the test range using 1 inch thick steel target plates stationed 300 meters from the firing site. One hundred rounds each of conventional armor-piercing incendiary projectiles, with and without aluminum lubricating caps, are fired at the target plates. Upon examination of the target, all conventional projectiles with aluminum caps are found to penetrate the armor, whereas only about 82 percent of those projectiles lacking the aluminum cap completely penetrate and pass through the plate.

In comparative firing tests, one hundred rounds of the projectiles containing a zirconium-tin incendiary are fired at the same steel plate. Examination of the target plate thereafter reveals that all rounds completely breach the plate.

From the results of the preceding tests, it can be seen that the projectiles containing the zirconium-tin incendiary and lacking the aluminum lubricating cap penetrate armor as effectively as projectiles with the cap. It is therefore apparent that the incendiary in the nosepiece of the projectile provides the desired lubrication and cushioning for the penetrator.

The preceding tests can be repeated with similar success by substituting the generically and specifically described incendiary compositions and firing conditions of this invention for those used in preceding examples.

From the foregoing description, one skilled in the art can easily ascertain the essential characteristics of this invention and, without departing from the spirit and scope thereof, can make various changes and modifications of the invention to adapt it to various usages and conditions. Consequently, such changes and modifications are properly, equitably, and intended to be, within the full range of equivalence of the following claims.

What we claim is:

1. In an armor-piercing incendiary projectile having a penetrator and an incendiary, the improvement which comprises: an incendiary having a matrix of a first metal selected from the group consisting of zirconium, titanium, thorium, hafium, uranium, and mixtures thereof; and interdispersed therein an intermetallic compound formed between said first metal and a second metal selected from the group consisting of tin, lead, and mixtures thereof.

2. The projectile as defined by claim 1, wherein the first metal constitutes, based upon the total weight of incendiary, from about 70 to 98.5% by weight, and the second metal constitutes from about 1.5 to 30% by weight.

3. The projectile as defined by claim 1, wherein the first metal constitutes, based upon the total weight of incendiary, from about 85 to 90% by weight, and the second metal constitutes from about 10 to 15% by weight.

4. The projectile as defined by claim 1, wherein the incendiary comprises a matrix of zirconium having dispersed therein an intermetallic compound of zirconium-tin.

5. The projectile as defined by claim 1, wherein the incendiary and penetrator are in juxtaposition.

6. The projectile as defined by claim 1, wherein the incendiary lies in contact with the penetrator.

7. The projectile as defined by claim 1, wherein a sufficient amount of incendiary is used about an ogival-shaped nose of the penetrator to provide cushioning and lubrication therefor.

8. The projectile as defined by claim 7, wherein said incendiary is contained within a hollow nosepiece.

9. The projectile as defined by claim 8, wheren the hollow nosepiece is in coupled locking engagement with one end of the penetrator.

10. The projectile as defined by claim 9, wherein a tubular adapter couples the penetrator and nosepiece in locking engagement.

11. The projectile as defined by claim 10, wherein the incendiary is held by the adapter against one end of the penetrator.

12. The projectile as defined by claim 11, wherein a radial flange projecting from the incendiary is in locking engagement with the nosepiece, thereby being pressed rearwardly against the penetrator.

13. The projectile as defined by claim 12, wherein said radial flange presses a deflectible extension of the nosepiece outwardly into locking engagement with the adapter.

14. The projectile as defined by claim 7, wherein one face of the incendiary is provided with a recess, the walls of which correspond to the contour of the penetrator nose in contact therewith.

* * * * *